US008210656B2

(12) United States Patent
Suzuki et al.

(10) Patent No.: US 8,210,656 B2
(45) Date of Patent: Jul. 3, 2012

(54) LIQUID EJECTING HEAD AND LIQUID EJECTING APPARATUS

(75) Inventors: Shigeki Suzuki, Shiojiri (JP); Katsuhiro Okubo, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 182 days.

(21) Appl. No.: 12/831,384

(22) Filed: Jul. 7, 2010

(65) Prior Publication Data

US 2011/0018942 A1 Jan. 27, 2011

(30) Foreign Application Priority Data

Jul. 23, 2009 (JP) ..... 2009-172555

(51) Int. Cl.
*B41J 2/05* (2006.01)

(52) U.S. Cl. ..... 347/65; 347/85; 347/63; 347/86; 347/50

(58) Field of Classification Search ..... 347/63–65, 347/84–87, 49, 50, 40–42
See application file for complete search history.

(56) References Cited

U.S. PATENT DOCUMENTS

| | | | | |
|---|---|---|---|---|
| 2002/0180835 | A1* | 12/2002 | Boyd et al. | 347/42 |
| 2002/0196318 | A1* | 12/2002 | Shimizu | 347/85 |
| 2007/0008385 | A1 | 1/2007 | Akahane | |

FOREIGN PATENT DOCUMENTS

| | | |
|---|---|---|
| JP | 2005-144691 | 6/2005 |
| JP | 2005-225219 | 8/2005 |
| JP | 2005-254546 | 9/2005 |
| JP | 2007-001109 | 1/2007 |
| JP | 2009-039894 | 2/2009 |
| JP | 2009-119667 | 6/2009 |

* cited by examiner

*Primary Examiner* — Matthew Luu
*Assistant Examiner* — Henok Legesse
(74) *Attorney, Agent, or Firm* — Workman Nydegger

(57) ABSTRACT

A liquid ejecting head includes: a plurality of head main bodies in which nozzle openings are arranged and manifolds communicate with the nozzle openings; and a passage member which includes a plurality of passages supplying a liquid supplied from an upstream side to the plurality of manifolds of the head main bodies. The plurality of head main bodies is disposed so that the manifolds are arranged in a first direction. The plurality of passages of the passage member includes a passage group in which an outflow port communicating with the manifold is disposed in the first direction and an inflow port to which the liquid is supplied from the upstream side is disposed in a second direction intersecting the first direction.

12 Claims, 10 Drawing Sheets

LIQUID EJECTING HEAD AND LIQUID EJECTING APPARATUS

The entire disclosure of Japanese Patent Application No: 2009-172555, filed Jul. 23, 2009 are expressly incorporated by reference herein.

BACKGROUND

1. Technical Field

The present invention relates to a liquid ejecting head and a liquid ejecting apparatus capable of ejecting a liquid from nozzle openings, and more particularly, to an ink jet printing head and an ink jet printing apparatus capable of ejecting ink as a liquid.

2. Related Art

A representative example of a liquid ejecting head capable of ejecting liquid droplets is an ink jet printing head capable of ejecting ink droplets. The ink jet printing head was suggested which includes a plurality of head main bodies which eject ink droplets from nozzle openings and a common passage member (head case) which is fixed to the plurality of head main bodies and supplies ink from a liquid storage member storing the ink to the head main bodies (for example, see JP-A-2005-225219).

A common manifold communicating with the plurality of nozzle openings is disposed in each head main body. A passage communicating with the manifold is disposed in the passage member. Two passages communicating with each of the manifolds of the adjacent head main bodies are disposed in a direction intersecting an arrangement direction of the head main bodies. Each passage communicates with each manifold at a deviated position in the longitudinal direction (the arrangement direction of the nozzle openings) (for example, see JP-A-2009-119667).

However, when the passage of the passage member communicates from the middle of the manifold at the deviated position in the longitudinal direction, a problem may arise in that a difference occurs in the pressure loss slopes at both ends of the manifold in the longitudinal direction. Moreover, when the difference in the pressure loss slopes occurs at both ends of the manifold in the longitudinal direction, a problem may arise in that a difference occurs in the ejection characteristics of the ink droplets ejected from the nozzle openings, the ink is not ejected uniformly, and thus the print quality deteriorates. In particular, when the number of nozzle openings is large to improve the print quality, the manifold is lengthened in the longitudinal direction, the difference in the pressure is increased, and thus the print quality may considerably deteriorate.

In order to solve the problem, the passage may be disposed to communicate with the middle of the manifold. In this case, however, a problem may also arise in that the size of the passage member becomes larger and thus a space for disposing another member is decreased in the passage member.

These problems arise not only in the ink jet printing head but also a liquid ejecting head ejecting a liquid other than ink.

SUMMARY

An advantage of some aspects of the invention is that it provides a liquid ejecting head and a liquid ejecting apparatus which are capable of making ejection characteristics uniform to improve print quality and which are miniaturized.

According to an aspect of the invention, there is provided a liquid ejecting head including: a plurality of head main bodies in which nozzle openings are arranged and manifolds communicate with the nozzle openings; and a passage member which includes a plurality of passages supplying a liquid supplied from an upstream side to the plurality of manifolds of the head main bodies. The plurality of head main bodies is disposed so that the manifolds are arranged in a first direction. The plurality of passages of the passage member includes a passage group in which an outflow port communicating with the manifold is disposed in the first direction and an inflow port to which the liquid is supplied from the upstream side is disposed in a second direction intersecting the first direction.

With such a configuration, arranging the inflow ports of the passages in the direction intersecting the first direction, it is possible to miniaturize the passage member. Moreover, by arranging the outflow ports in the first direction, the passages can communicate with the middles of the manifolds arranged in the first direction. By reducing the difference between the pressure loss slopes of the manifolds in the direction intersecting the first direction, it is possible to equalize the liquid ejection characteristics of the liquid ejected from the nozzle openings.

In the liquid ejecting head, the passages organizing the passage group may communicate with the manifolds different from each other. With such a configuration, each passage communicates with the middle of each manifold of the adjacent head main bodies.

The liquid ejecting head may further include a second passage member in which a supply communication passage communicating with the inflow port of the passage member is formed. With such a configuration, since another component such as a circuit board can be disposed between the passage member and the second passage member, it is possible to realize miniaturization. Moreover, it is possible to prevent the liquid from invading the other components.

In the liquid ejecting head, the lengths of the plurality of passages of the passage member may be equal to each other. With such a configuration, it is possible to reduce the difference in the pressure loss between the passages. Therefore, it is possible to equalize the liquid ejection characteristics.

In the liquid ejecting head, the head main body may include a pressure generating chamber communicating with the nozzle opening, an actuator device generating pressure variation in the pressure generating chamber, and a wiring member connected to the actuator device. A circuit board connected to the wiring member and supplying a driving signal to the actuator device via the wiring member may be disposed between the passage member and the second passage member. With such a configuration, the passage member and the second passage member are configured as different members, the circuit board and the wiring member are connected to each other between the passage member and the second passage member. Therefore, since the circuit board can be easily treated and the plurality of head main bodies can be easily connected to one circuit board, it is possible to miniaturize the liquid ejecting head and to reduce the cost.

In the liquid ejecting head, the wiring member may be a flexible wiring member in which a wiring is formed in a flexible member. With such a configuration, it is possible to reliably realize connection with the circuit board and the connection with the head main bodies.

In the liquid ejecting head, the wiring member may be inserted into a through-hole formed between the adjacent passage groups of the passage member. By arranging the inflow ports of the passages in the direction intersecting the first direction, the width of the through-hole can be widened. Therefore, it is possible to insert the wiring member reliably.

According to another aspect of the invention, there is provided a liquid ejecting apparatus including the liquid ejecting head with the above-described configuration.

With such a configuration, it is possible to improve print quality and miniaturize the liquid ejecting apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments of the invention will be described in detail.

First Embodiment

Figure 1:
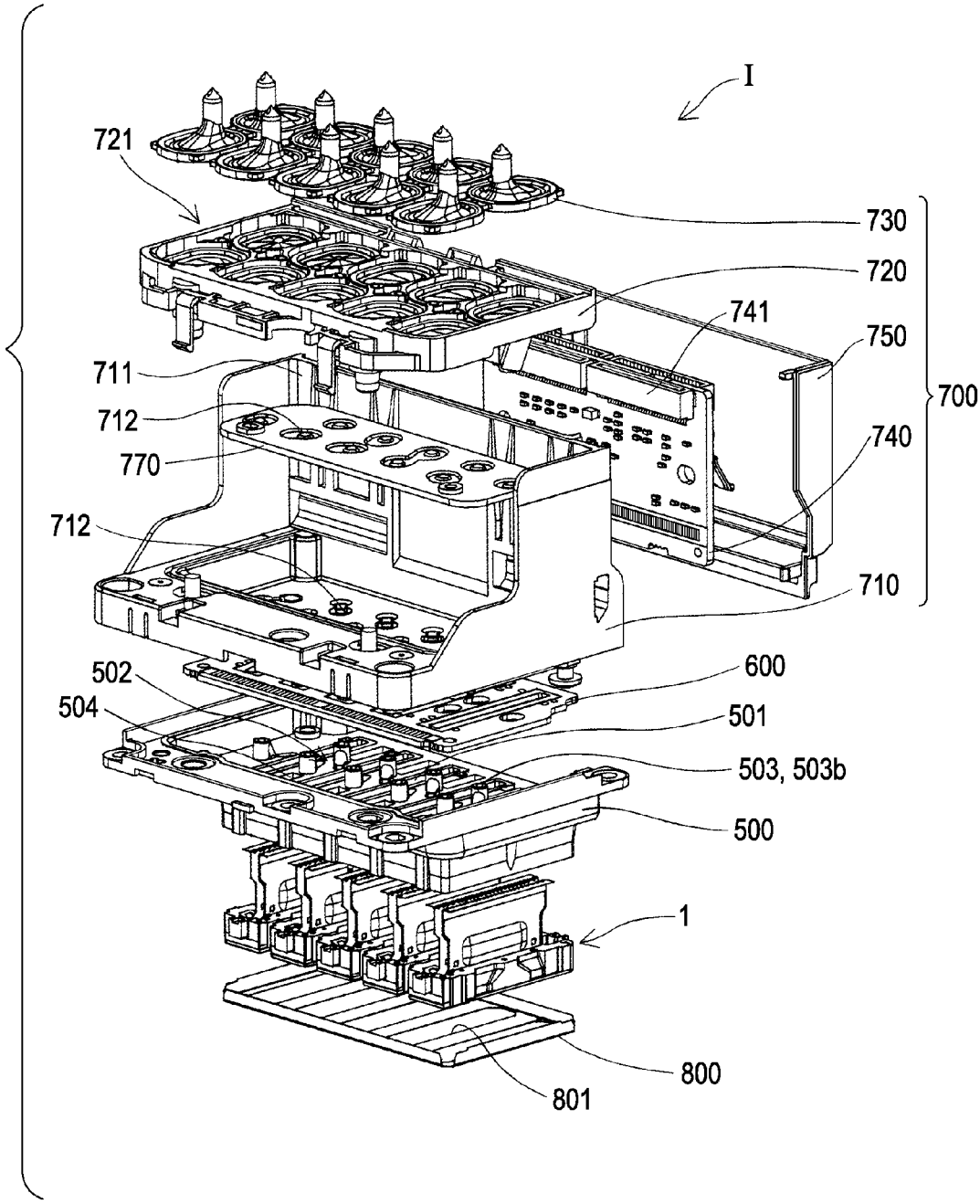
FIG. 1 is an exploded perspective view illustrating a printing head according to a first embodiment of the invention.
Figure 2:
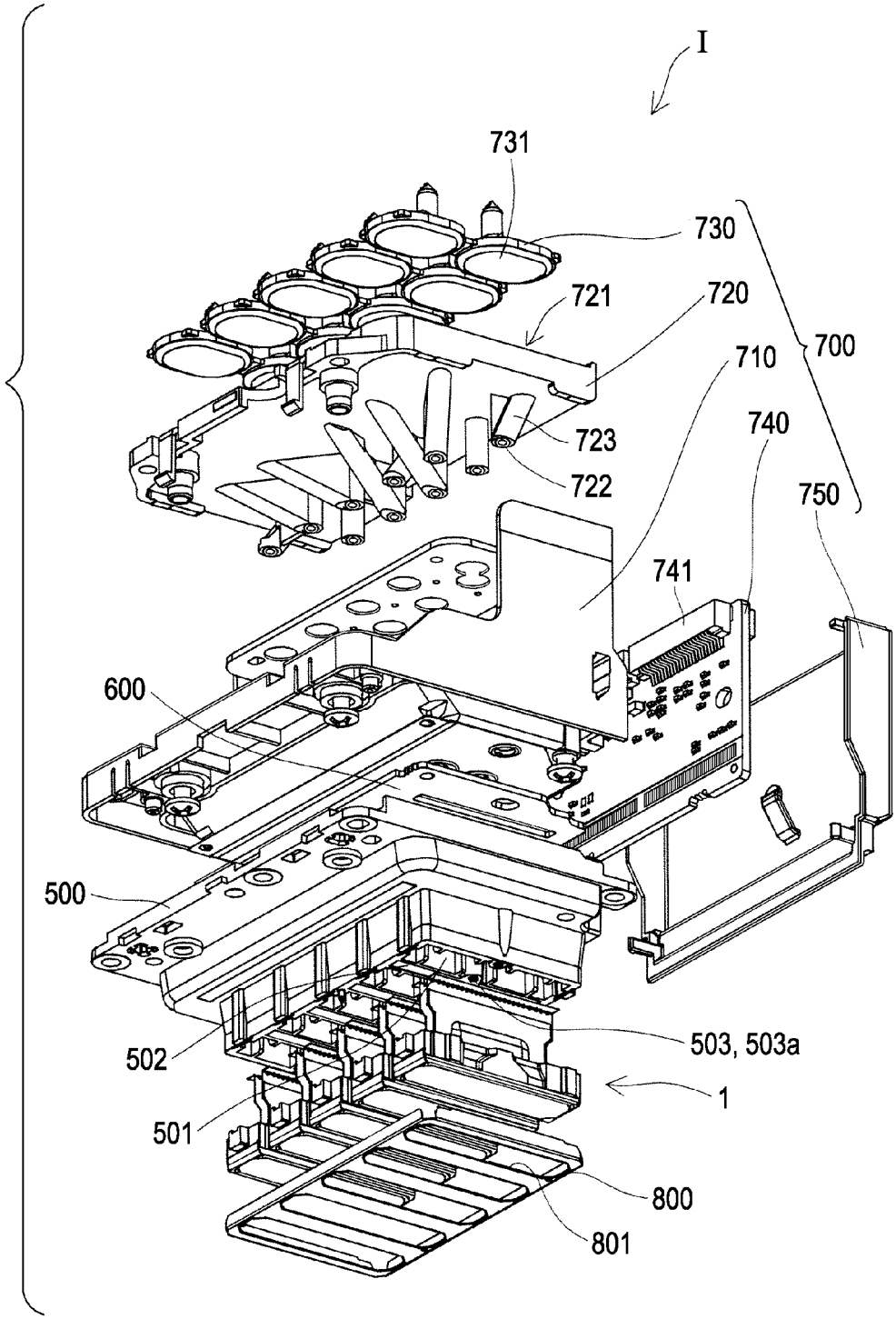
FIG. 2 is an exploded perspective view illustrating the printing head according to the first embodiment of the invention.

FIGS. 1 and 2 are exploded perspective views illustrating an ink jet printing head, which is an example of a liquid ejecting head according to a first embodiment of the invention. As shown in FIG. 1, an ink jet printing head I includes: a plurality of head main bodies 1 ejecting ink; a passage member 500 fixed in a first direction in which the plurality of head main bodies 1 is arranged; a circuit board 600 disposed opposite to the head main body 1 with reference to the passage member 500; a retaining member 700 serving as a second passage member and disposed on the side of the circuit board 600 with reference to the passage member 500; and a cover head 800 disposed opposite to the passage member 500 with reference to the head main body 1.

Figure 3:
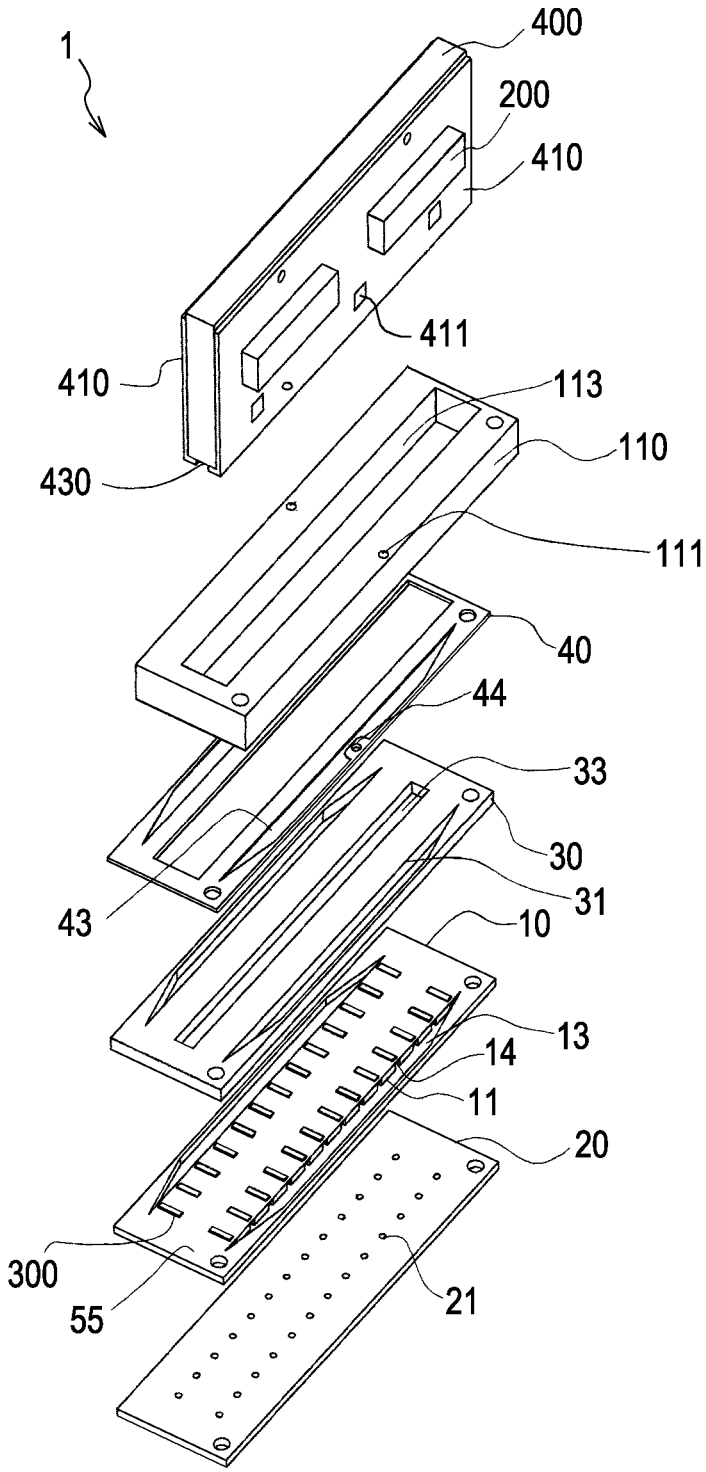
FIG. 3 is an exploded perspective view illustrating the printing head according to the first embodiment of the invention.
Figure 4:
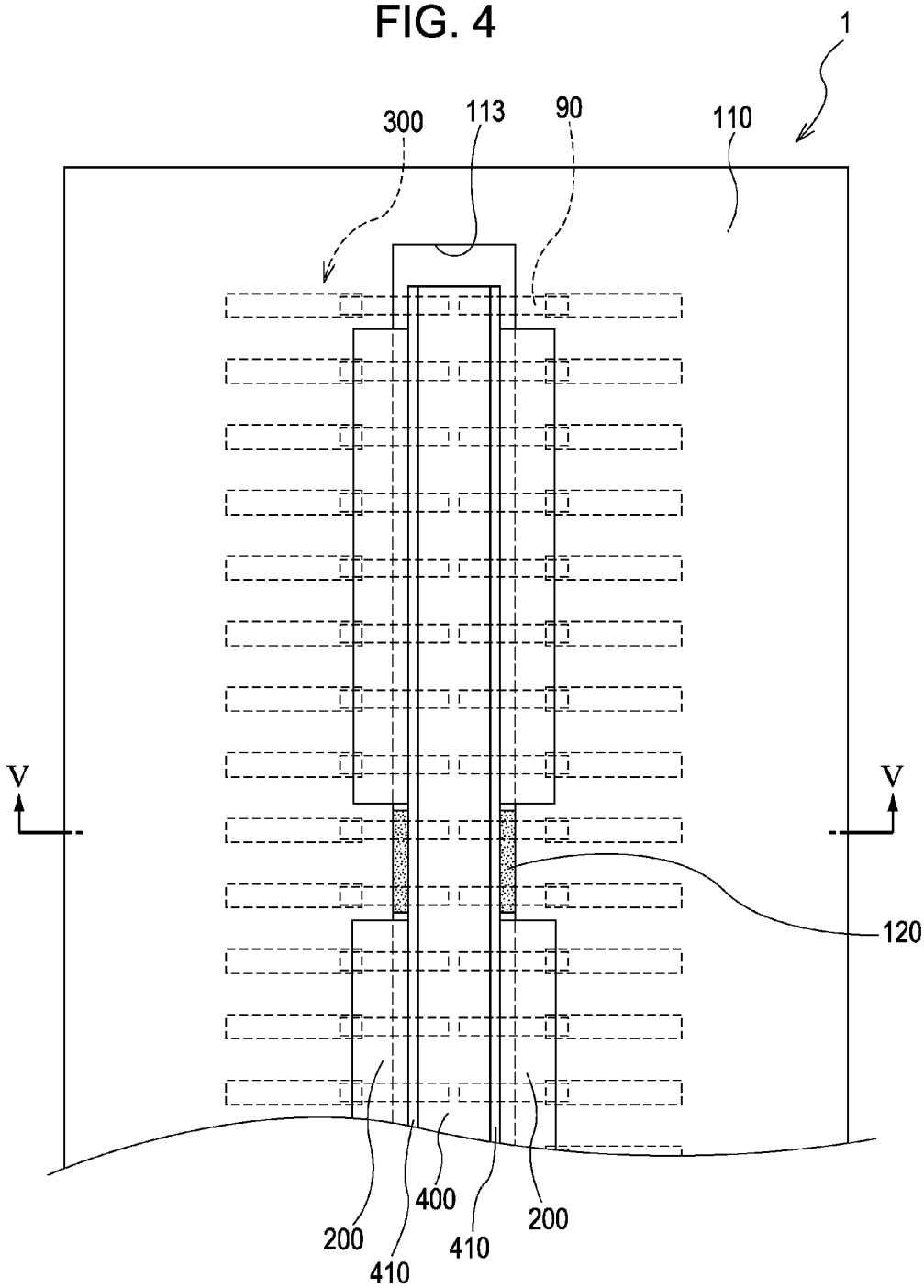
FIG. 4 is a plan view illustrating a head main body according to the first embodiment of the invention.
Figure 5:
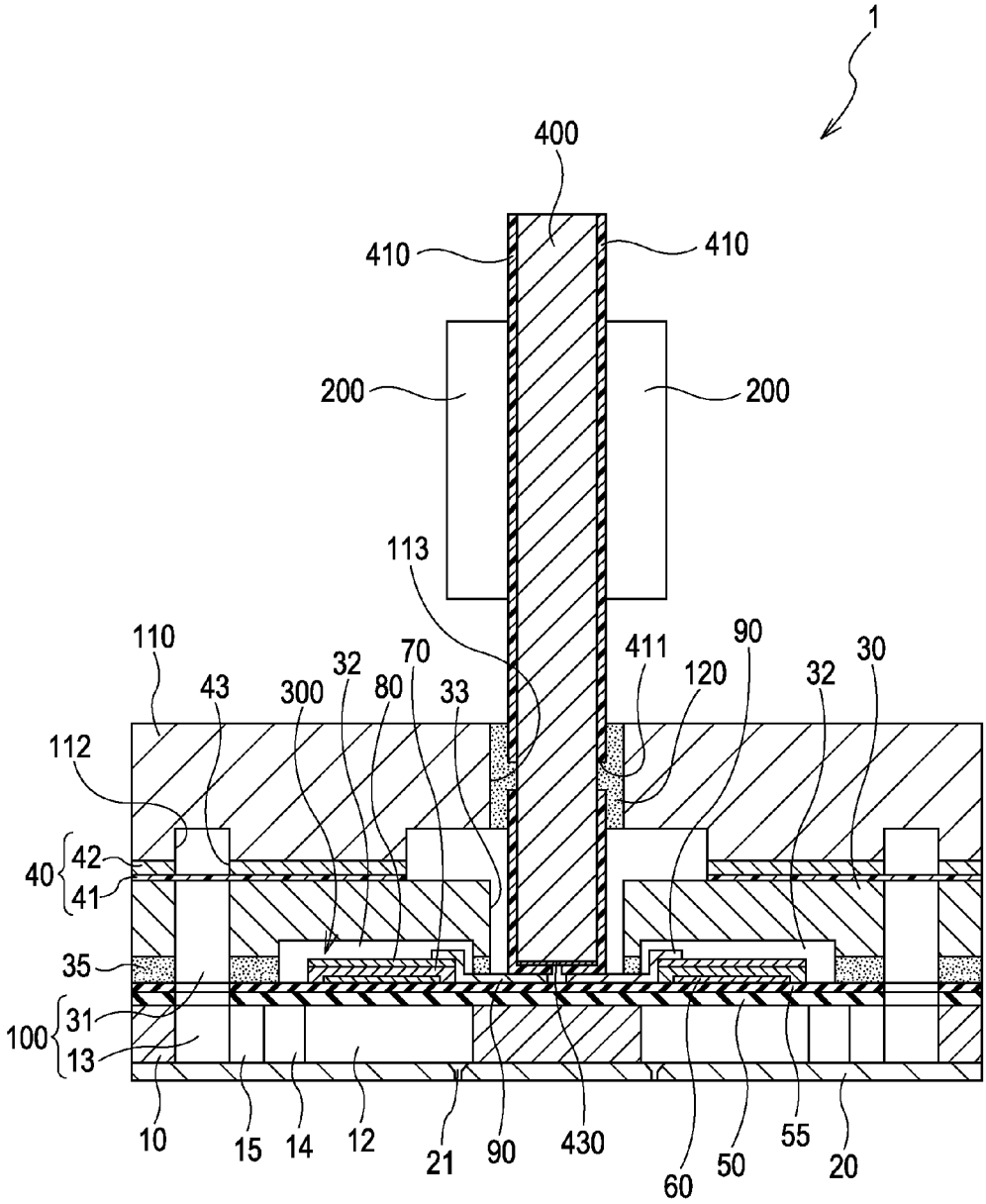
FIG. 5 is an enlarged perspective view illustrating the head main body according to the first embodiment of the invention.

First, the head main body 1 will be described with reference to FIGS. 3 to 5. FIG. 3 is an exploded perspective view illustrating the head main body according to the first embodiment of the invention. FIG. 4 is a plan view illustrating the head main body. FIG. 5 is a sectional view taken along the line V-V of FIG. 4.

As illustrated in the drawings, a passage forming board 10 of the head main body 1 is formed of a silicon single-crystalline board in this embodiment. An elastic film 50 formed of silicon dioxide is formed on one side of the passage forming board 10.

In the passage forming board 10, a plurality of pressure generating chambers 12 partitioned by wall portions 11 is arranged in two rows in its width direction. A communication portion 13 is formed in an outside region in a longitudinal direction of the pressure generating chambers 12 of each row. The communication portion 13 and each pressure generating chamber 12 communicate with each other via an ink supply passage 14 and a communication passage 15 formed in each pressure generating chamber 12. The communication portion 13 communicates with a manifold portion 31 of a protective board 30, which is described below, and forms a part of the manifold 100 serving as a common ink chamber of each row of the pressure generating chambers 12. The ink supply passage 14 has a width narrower than that of the pressure generating chamber 12, and thus maintains uniform passage resistance of ink flowing from the communication portion 13 to the pressure generating chamber 12. In this embodiment, the ink supply passage 14 is formed on one side of the width of the passage, but the ink supply passage may be formed on both sides of the width of the passage. Alternatively, the ink supply passage may be formed not in the width of the passage but in the width direction. Each communication passage 15 is formed by extending the wall portions 11 on both sides of the pressure generating chamber 12 in the width direction toward the communication portion 13 and partitioning a space between the ink supply passage 14 and the communication portion 13. That is, in the passage forming board 10, the plurality of wall portions 11 partitions the ink supply passage 14 having a cross-section area smaller than the cross-section area of the pressure generating chamber 12 in the width direction and the communication passage 15 communicating with the ink supply passage 14 and having the cross-section area larger than the cross-section area of the ink supply passage 14 in the width direction.

On the opening surface of the passage forming board 10, a nozzle plate 20 having punched nozzle openings 21 communicating with the vicinity of the ends of the pressure generating chambers 12 opposite to the ink supply passage 14 are fixed by an adhesive, a thermal welding film, or the like. In this embodiment, two nozzle rows in which the nozzle openings 21 are arranged in parallel are formed in one head main body 1 having two rows in which the pressure generating chambers 12 are arranged in parallel in the passage forming board 10. The nozzle plate 20 is formed of glass ceramics, a silicon single-crystalline board, stainless steel, or the like.

On the other hand, as described above, the elastic film 50 is formed on the opposite side of the opening surface of the passage forming board 10. An insulating film 55 is formed on the elastic film 50. A first electrode 60, a piezoelectric layer 70, and a second electrode 80 are sequentially laminated on the insulating film 55 to form a piezoelectric element 300 serving as an actuator device according to this embodiment. The piezoelectric element 300 is an element including the first electrode 60, the piezoelectric layer 70, and the second electrode 80. In general, in the piezoelectric element 300, either one electrode serves as a common electrode, the other electrode and the piezoelectric layer 70 are patterned in each pressure generating chamber 12. Here, a portion formed by the patterned other electrode and the patterned piezoelectric layer 70 and deformed with application of voltage to both electrodes is called a piezoelectric active portion. In this embodiment, the first electrode 60 close to the passage forming board 10 serves as a common electrode of the piezoelectric element 300. The second electrode 80 serves as an individual electrode of the piezoelectric element 300. However, the first electrode 60 may serve as the individual electrode and the second electrode 80 may serve as the common electrode depending on the configuration of a driving circuit or a wiring. Here, the piezoelectric element 300 and a vibration plate in which deformation occurs by the driving of the piezoelectric element 300 are called the actuator device. In the above-described example, the elastic film 50, the insulating film 55, and the first electrode 60 operate as a vibration plate, but the invention is not limited thereto. For example, only the first electrode 60 may operate as the vibration plate without forming the elastic film 50 and the insulating film 55. Alternatively, the piezoelectric element 300 may substantially serve as the vibration plate.

The piezoelectric layer 70 formed on the first electrode 60 is formed of a piezoelectric material realizing an electromechanical transduction operation, and particularly, of a ferroelectric material with a perovskite structure among piezoelectric materials. It is preferable that the piezoelectric layer 70 is formed of a crystalline film with the perovskite structure. For example, it is preferable that the piezoelectric layer 70 is formed of a ferroelectric material such as lead zirconate titanate (PZT) or a material in which metal oxide such as niobium oxide, nickel oxide, or magnesium oxide is added to the lead zirconate titanate.

A lead electrode 90 (connection terminal) extending up to the insulating film 55 and formed of gold (Au), for example, is connected to each second electrode 80 serving as the individual electrode of the piezoelectric element 300. One end of the lead electrode 90 is connected to the second electrode 80 and the other end of the lead electrode 90 extends between the rows in which the piezoelectric elements 300 are arranged in parallel. More specifically, the other end of the lead electrode 90 is connected to a COF board 410 which is a flexible wiring member, which is described below.

The protective board 30 including the manifold portion 31 forming at least a part of the manifold 100 is joined to the passage forming board 10, in which the piezoelectric elements 300 are formed, that is, on the first electrode 60, the insulating film 55, and the lead electrode 90 by the adhesive 35. In this embodiment, the manifold portion 31 perforates through the protective board 30 in the thickness direction so as to be formed in the width direction of the pressure generating chamber 12. Therefore, as described above, the manifold portion 31 communicates with the communication portion 13 of the passage forming board 10 so as to form the manifold 100 serving as the common ink chamber of the pressure generating chambers 12. Two manifolds 100 are disposed to correspond to the rows of the pressure generating chambers 12. Each of the manifolds 100 communicates with the nozzle row in which the nozzle openings 21 are arranged. In this embodiment, the communication portion 13 forming the manifold 100 is formed in the passage forming board 10, but the invention is not limited thereto. For example, a plurality of communication portions 13 of the passage forming board 10 may be formed in the pressure generating chambers 12, respectively, so that only the manifold portion 31 serves as the manifold. For example, only the pressure generating chambers 12 may be formed in the passage forming board 10. In addition, the ink supply passage 14 communicating with the manifold and each pressure generating chamber 12 may be formed in the member (for example, the elastic film 50 or the insulating film 55) interposed between the passage forming board 10 and the protective board 30.

The piezoelectric element retaining unit 32 serving as a retaining unit having a space to the degree of not interrupting the movement of the piezoelectric element 300 is disposed in an area facing the piezoelectric element 300 of the protective board 30. The piezoelectric element retaining unit 32 may be sealed in an airtight manner or may not be sealed in an airtight manner, as long as the piezoelectric element retaining unit 32 has the space to the degree of not interrupting the movement of the piezoelectric element 300. In this embodiment, since the piezoelectric elements 300 are arranged in two rows, the piezoelectric element retaining unit 32 is disposed to correspond to each of the rows in which the piezoelectric elements 300 are arranged. That is, in the protective board 30, two piezoelectric element retaining units 32 are disposed in the arrangement direction of the rows in which the piezoelectric elements 300 are arranged.

It is preferable that the protective board 30 is formed of a material, such as glass or ceramic material, with substantially the same coefficient of thermal expansion as that of the passage forming board 10. In this embodiment, the protective board 30 is formed of the same silicon single-crystalline board as that of the passage forming board 10.

A through-hole 33 is formed in the protective board 30 so as to perforate through the protective board 30 in the width direction. In this embodiment, the through-hole 33 is formed between the two piezoelectric element retaining units 32. The vicinities of the ends of the lead electrodes 90 drawn from each piezoelectric element 300 are exposed to the through-hole 33.

A driving circuit 200 driving the piezoelectric elements 300 is mounted in the COF board 410 which is a flexible wiring board. Here, the lower end of the COF board 410 is connected and substantially perpendicularly erected to the lead electrodes 90. Therefore, the COF board 410 is adhered to the side surfaces of a supporting member 400 with a plate shape. That is, the supporting member 400 has a rectangular shape of which both side surfaces are vertical surfaces. In this embodiment, the supporting member 400, the COF board 410, and the driving circuit 200 form a wiring board.

More specifically, in the head main body 1 according to this embodiment, the pressure generating chambers 12 are arranged in two rows in the passage forming board 10 and the piezoelectric elements 300 arranged in two rows in the width direction (the width direction of the piezoelectric elements 300) of the pressure generating chamber 12. That is, the two rows of the pressure generating chambers 12, the piezoelectric elements 300, and the lead electrodes 90 face each other. The COF boards 410 are respectively adhered to both side surfaces of the supporting member 400 of which the lower portion is inserted into the through-hole 33. Each lower end of the COF board 410 is connected to the ends of the lead electrodes 90 arranged in each row of the piezoelectric elements 300 and the first electrode 60, and is erected substantially perpendicularly. In this embodiment, one COF board 410 is formed on the each side surface of the supporting member 400. Therefore, two COF boards 410 are disposed in one supporting member 400.

Since the COF board 410, which is the flexible single wiring board, is easily bent and it is difficult to erect the flexible board, it is possible to prevent the COF board 410 from being bent to erect the COF board 410 by joining the COF board 410 to the supporting member 400 which is a rigid member supporting the COF board 410. Of course, the supporting member 400 may not be provided. Instead, only the COF board 410 may be disposed so as to be erected in a direction perpendicular to the surface in which the piezoelectric elements 300 of the passage forming board 10 are formed. Alternatively, the COF boards 410 are adhered to the side surfaces of the supporting member 400, but the invention is not limited thereto. For example, the COF board 410 may be put in the supporting member 400 for the retention.

As shown in FIG. 5, a buffering member 430 formed of Teflon® or the like is disposed between the lower end surface of the supporting member 400 and the lower end surface of the COF board 410. The lower end of the COF board 410 and the lead electrodes 90 are electrically connected to each other, since the lower end of the COF board 410 and the lead electrodes 90 contain conductive particles (for example, an anisotropic conductive material such as an anisotropic conductive film (ACF) or an anisotropic conductive paste (ACP)). That is, by pressing down the supporting member 400, the COF board 410 can be pressed down through the lower end surface of the supporting member 400 toward the lead electrodes 90. In this way, the COF board 410 and the lead electrodes 90 are electrically connected to each other by the conductive particles. At this time, the buffering member 430 functions to equalize the pressing force against the COF board 410. Here, it is preferable that the lower end surface of the supporting member 400 and the lower end of the COF board 410 or the lower end surface of the supporting member 400 coming into contact with the buffering member 430 has surface accuracy which is five times the diameter of the conductive particle. Therefore, since the pressing force acting to the conductive particles can be equalized through the lower end of the COF board 410 together with the presence of the buffering member 430, the good electric connection is ensured by the conductive particles. Of course, the invention is not limited to the case where the lower end of the COF board 410 and the electrodes 90 are connected to each other by the conductive particles. For example, the COF board 410 and the electrodes 90 may be connected by melting a metal material such as solder.

It is preferable that the supporting member 400 has a coefficient of thermal conductivity of dissipating heat so that the temperature of the driving circuit 200 is less than the junction temperature even when the head main body 1 is used at the guaranteed highest use temperature. Therefore, even when the driving circuit is operated under the severest load condition, sufficient heat dissipating effect can be obtained, thereby driving the driving circuit stably for a long time. For this reason, in this embodiment, the supporting member 400 is formed of stainless steel (SUS). In this case, the supporting member 400 enables the heat generated by the driving circuit 200 to be absorbed in the ink which flows in the passage forming board 10 via the passage forming board 10. As a result, the heat generated by the driving circuit 200 can be dissipated effectively. The same operational effect can be obtained by decreasing the distance between the surface of the passage forming board 10 and the driving circuit 200 sufficiently small, even when metal such as the SUS is not used. That is, it is preferable that the distance between the surface of the passage forming board 10 and the driving circuit 200 is set sufficiently small so that the temperature of the driving circuit 200 is less than the junction temperature even when the head main body 1 is used at the guaranteed highest use temperature.

The supporting member 400 is formed of a material, such as stainless steel or silicon, with the same coefficient of thermal expansion as that of the head case 110 which is a retaining member, which is described below.

As shown in FIG. 5, a compliance board 40 formed by a sealing film 41 and a fixing plate 42 is joined to the protective board 30. Here, the sealing film 41 is formed of a material (for example, a polyphenylene sulfide (PPS) film) with flexibility and low rigidity. One side of the manifold portion 31 is sealed by the sealing film 41. The fixing plate 42 is formed of a material (for example, stainless steel (SUS)), such as metal, with rigidity. Since the area facing the manifold 100 of the fixing plate 42 serves as an opening 43 completely removed in the thickness direction, one side of the manifold 100 is sealed only by the sealing film 41 with flexibility.

The head case 110 serving as a retaining member is disposed on the compliance member 40. An ink introduction passage 111 communicating with an ink introduction port 44 and supplying the ink from a storage unit such as a cartridge to the manifold 100 is formed in the head case 110. An outlet portion 112 (see FIG. 5) with a concave shape facing the opening 43 is formed in the head case 110, and the opening 43 is appropriately deformed. A wiring member holding hole 113 communicating with the through-hole 33 formed in the protective board 30 is formed in the head case 110. Therefore, the lower end of the COF board 410 is connected to the lead electrodes 90 in the state where the COF board 410 and the supporting member 400 are inserted into the wiring member holding hole 113. The COF board 410 and the supporting member 400 inserted into the wiring member holding hole 113 of the head case 110 are adhered to the head case 110 by an adhesive 120. Here, the head case 110 and the COF board 410 may be adhered by the adhesive 120. However, when the head case 110 and the supporting member 400 are directly adhered to each other, the supporting member 400 can be reliably retained in the head case 110. That is, by adhering the head case 110 and the supporting member 400 as the rigid bodies to each other, it is possible to retain the COF board 410 and the lead electrodes 90 in a reliable connection state. Therefore, it is possible to prevent a problem such as line disconnection caused when the COF board 410 and the lead electrodes 90 are separated from each other. In this embodiment, a holding hole 411 is formed in the COF board 410 so as to perforate in the thickness direction at a predetermined gap along the arrangement direction of the lead electrodes 90. The head case 110 and the supporting member 400 are adhered to each other through the holding hole 411 by the adhesive 120. In order for the head case 110 and the supporting member 400 to be directly adhered to each other, it is preferable that the head case 110 and the supporting member 400 are formed of a material with the same coefficient of thermal expansion. In this embodiment, the head case 110 and the supporting member 400 are formed of stainless steel. Therefore, when the head main body 1 is expanded or contracted by heat, it is possible to prevent bending or breaking due to a difference between the coefficients of thermal expansion of the head case 110 and the supporting member 400. When the head case 110 and the supporting member 400 are formed of materials with different coefficients of thermal expansion, the supporting member 400 may press down the passage forming board 10, and thus may crack may occur in the passage forming board 10. Moreover, it is preferable that the head case 110 and the supporting member 400 are formed of a material with substantially the same coefficient of thermal expansion as that of the protective board 30 to which the head case 110 and the supporting member 400 are fixed.

In the head main body 1, the COF board 410 protrudes on the side opposite to an ink ejection surface in which the nozzle openings 21 are opened.

As shown in FIGS. 1 and 2, the ink jet printing head I according to this embodiment includes the passage member 500 disposed on the side of the COF board 410 of the head main body 1, the circuit board 600 disposed on the opposite side of the head main body 1 with reference to the passage member 500, and the retaining member 700 which is the second passage member disposed on the opposite side of the head main body 1 with reference to the passage member 500.

Figure 6:
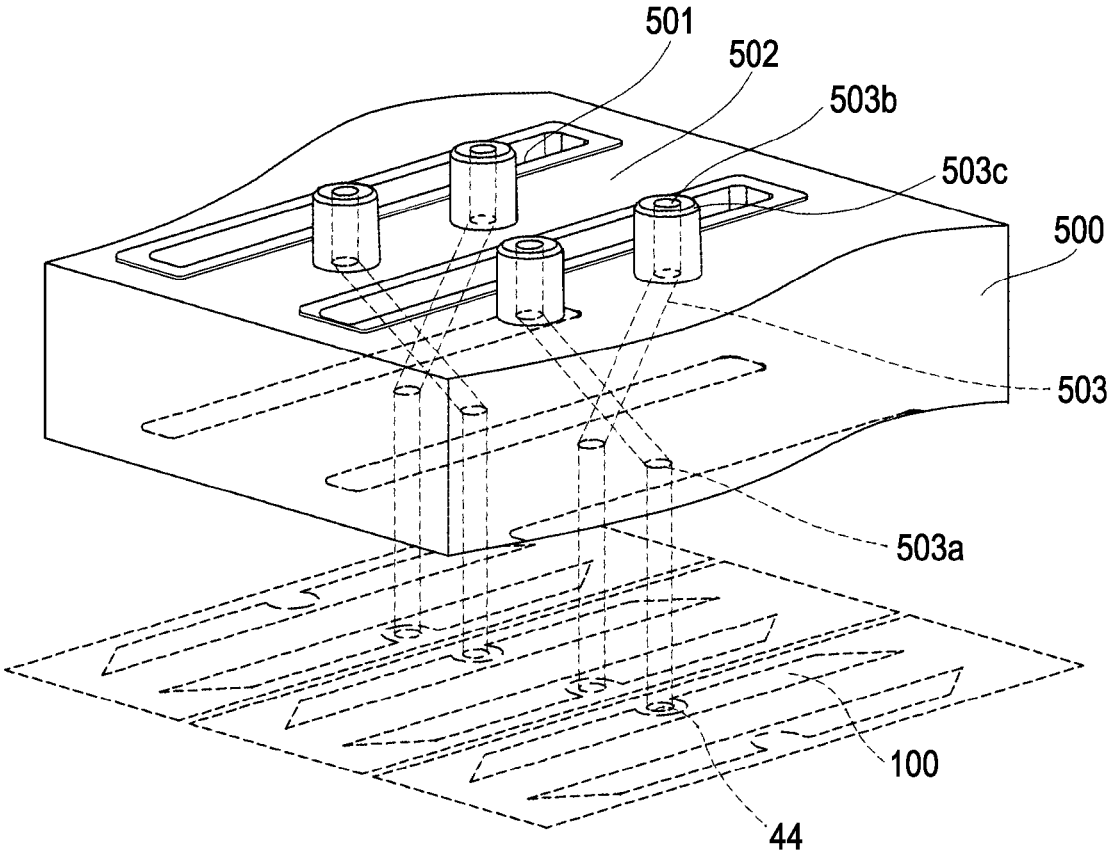
FIG. 6 is an enlarged perspective view illustrating the main portions of a passage member according to the first embodiment of the invention.
Figure 7A:
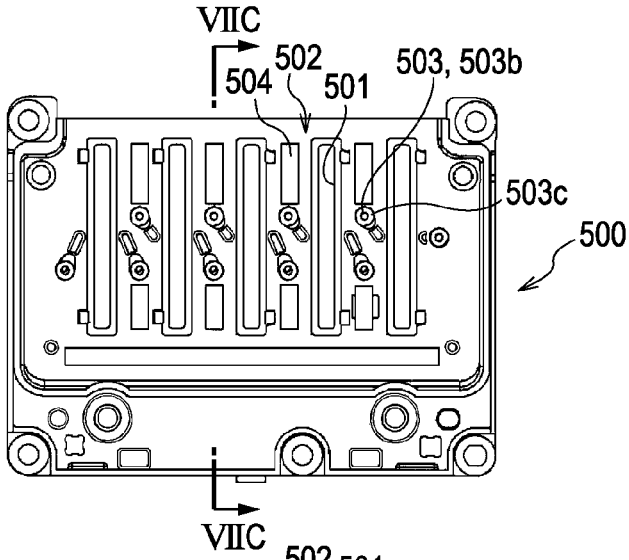
FIGS. 7A to 7C are plan views and a sectional view illustrating the passage member according to the first embodiment of the invention.
Figure 7B:
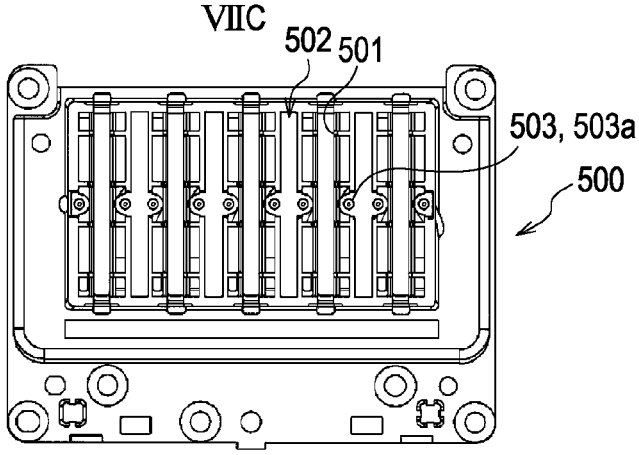
Figure 7C:
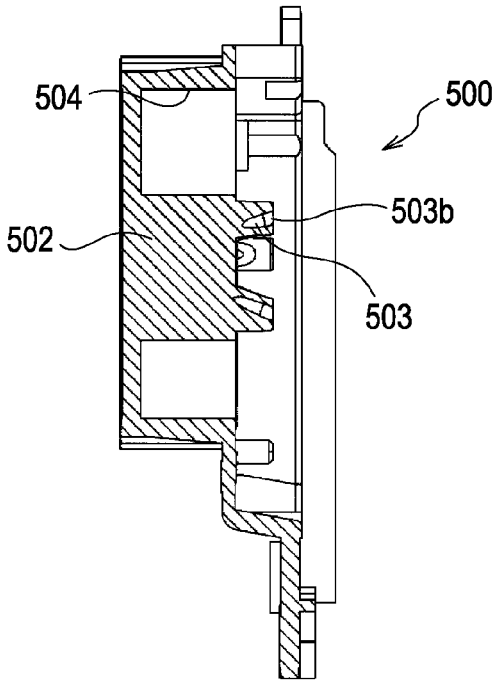
Figure 8A:
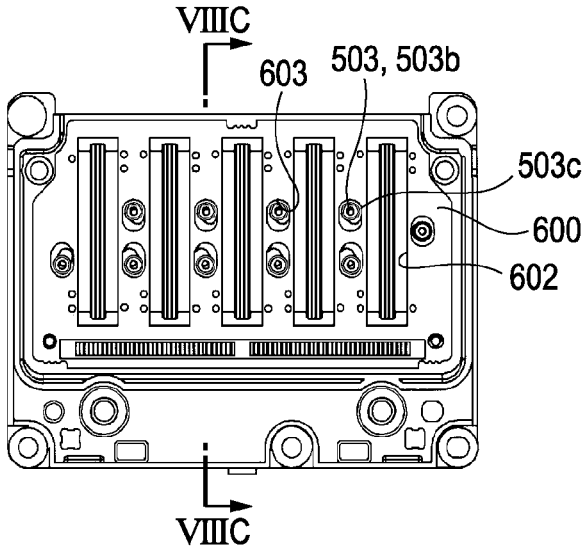
FIGS. 8A to 8C are plan views and a sectional view illustrating the passage member, the head main body, and a circuit board assembled according to the first embodiment of the invention.
Figure 8B:
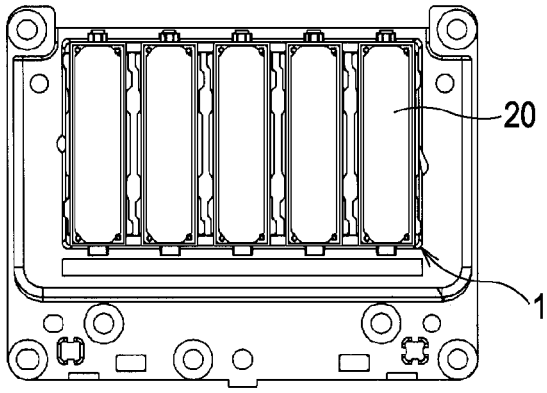
Figure 8C:
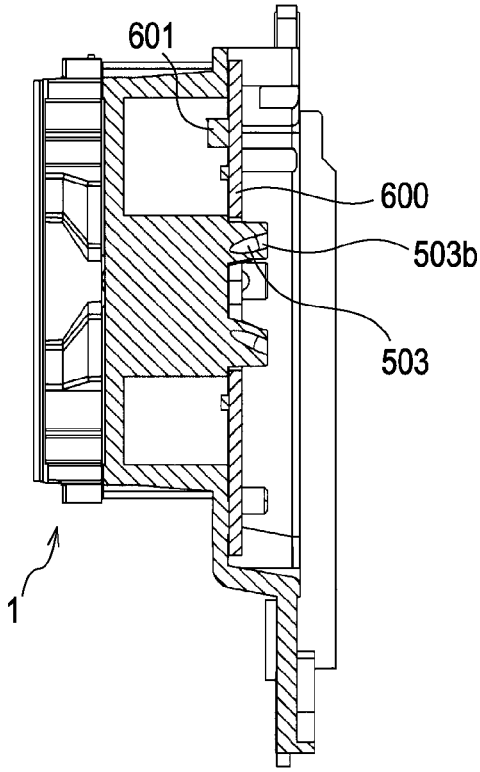

The passage member 500 will be described in more detail with reference to FIG. 6, FIGS. 7A to 7C, and FIGS. 8A to 8C. FIG. 6 is an enlarged perspective view illustrating the main elements of the passage member. FIG. 7A is a plan view from the side of the head main bodies of the passage member. FIG. 7B is a plan view from the side of the circuit board of the passage member. FIG. 7C is a sectional view taken along the line VIIC-VIIC of FIG. 7A. FIG. 8A is a plan view illustrating the passage member, the circuit board, and the head main bodies in an assembled state. FIG. 8B is a plan view illustrating the head main bodies. FIG. 8C is a sectional view taken along the line VIIIC-VIIIC of FIG. 7A.

As shown in FIGS. 1 and 2, the plurality of head main bodies 1 is fixed to the bottom surface of the passage member 500. In this embodiment, five head main bodies 1 are fixed in a first direction which is the arrangement direction of the nozzle rows of the head main bodies 1.

As shown in FIG. 6 and FIGS. 7A to 7C, the passage member 500 includes: the COF board 410 which serves as a wiring member with flexibility and is connected to the lead electrodes supplying driving signals to the pressure generating elements of the head main bodies 1; and through-holes 501 through which the supporting member 400 is inserted and which are formed through in the thickness direction. The through-holes 501 are partitioned by partition walls 502 and are formed separately for the head main bodies 1. The through-hole 501 has an opening area smaller than the outer diameter of the head case 110 of the head main body 1 and is formed so as to have a size so that the COF board 410 and the supporting member 400 can be inserted. Each head main body 1 is fixed to the circumference of each through-hole 501. In this embodiment, since five head main bodies 1 are retained in one passage member 500, the five through-holes 501 of which the number is the same as that of the head main bodies 1 are formed.

In the partition wall 502 partitioning the through-hole 501, a passage 503 communicating the ink introduction passage 111 formed in the head case 110 of the head main body 1 is formed to supply the ink to the manifold 100 via the ink introduction passage 111. The passage 503 is opened to the side of the head main body 1 of the passage member 500 and is formed in the thickness direction so as to be opened to the side of the retaining member 700. A plurality of the passages 503 is formed in one partition wall 502. For example, two passages 503 are formed. Two passages 503 formed one partition wall 502 are opened to be arranged in a direction intersecting the arrangement direction of the head main bodies 1 on the side of the circuit board 600, as shown in FIGS. 6 and 7A. Two passages 503 are opened to be arranged in the same direction as the arrangement direction of the head main bodies 1 on the side of the head main bodies 1, as shown in FIGS. 6 and 7B. That is, in a passage group organized by two passages 503 formed on one partition wall 502, outflow ports 503*a* of the two passages 503 communicating the manifold 100 are arranged in the same direction as the first direction which is the arrangement direction of the head main bodies 1. In the passage group organized by the two passages 503 formed on one partition wall 502, inflow ports 503*b* on the upstream side (on the side of the supply communication passage of the retaining member 700) of the two passages 503 are arranged in the direction intersecting the first direction which is the arrangement direction of the head main bodies 1. Since the outflow ports 503*a* and the inflow ports 503*b* are formed at different positions in a plan view, the passages 503 are inclined in a direction perpendicular to the surface to which the head main bodies 1 are fixed, as shown in FIG. 7C.

Two passages 503 formed on one partition wall 502 and organizing one passage group communicate with the manifolds 100 via the ink introduction ports 111 of two adjacent head main bodies 1. In one head main body 1, two manifolds 100 are arranged in the first direction which is the arrangement direction of the head main bodies 1. Each manifold 100 communicates with the nozzle row in which the plurality of nozzle openings 21 is arranged. Since the outflow ports 503*a* of the passages 503 are arranged in the first direction, as described above, each of the outflow ports 503*a* communicates with the middle of the manifold 100 in the longitudinal direction (the arrangement direction of the nozzle openings 21). Moreover, when the outflow ports 503*a* are arranged in the longitudinal direction of the manifold 100, the passage 503 may not communicate with the middle of the manifold 100 but may communicate at a biased position in the longitudinal direction of the manifold 100. When the outflow port 503*a* communicates at the biased position in the longitudinal direction of the manifold 100, a difference may occur between the pressure loss slopes at both ends of the manifold 100 in the longitudinal direction of the manifold 100. Therefore, a difference in the ejection characteristics of the ink droplets ejected from the nozzle opening may occur, the ink may not be ejected uniformly, and thus the print quality may deteriorate. When the inflow ports 503*b* are arranged in the first direction so as to match with the outflow ports 503*a*, a space is necessary to arrange the inflow ports 503*b* in the first direction, and thus a space is necessary in the circuit board 600 to avoid the inflow port 503*b*. Therefore, since a desired electronic component may not be mounted in the circuit board 600, the size may be larger.

In this embodiment, by permitting the outflow port 503*a* of each passage 503 to communicate with the middle of the manifold 100, it is possible to prevent occurrence of the difference between the pressure loss slopes in the both ends of the manifold 100 in the longitudinal direction of the manifold 100. Moreover, it is possible to reduce the difference in the ejection characteristics of the ink droplets ejected from the nozzle openings 21. Therefore, the print quality can be improved. In particular, even when numerous nozzle passages 21 are formed to improve the print quality, it is possible to suppress the occurrence of the difference between the pressure loss slopes at both ends of the manifold 100 in the longitudinal direction of the manifold 100. Therefore, it is possible to prevent the deterioration in the print quality.

In this embodiment, by permitting the outflow port 503*a* of each passage 503 to communicate with the middle of the manifold 100 and arranging the plurality of inflow ports 503*b* in the direction intersecting the first direction, it is possible to prevent the size of the passage member 500 from being increased. Moreover, it is possible to mount a desired mounting unit in the circuit board 600 in which the passage member 500 is mounted. In particular, since the through-hole 501 into which the COF board 410 is inserted is formed in the passage member 500 according to this embodiment, the area where an electronic component is mounted in the circuit board 600 is narrow. However, by arranging the inflow ports 503*b* of the passages 503 in the direction intersecting the first direction, it is possible to prevent the width of the through-hole 501 from being narrowed. Therefore, the passage member 500 can be miniaturized.

In this embodiment, the lengths of the passages 503 organizing the passage group are substantially the same as each other. With such a configuration, the pressure loss of the ink supplied to each manifold 100 via each passage 503 can be made uniform and thus the ink ejection characteristics can be made uniform.

An opening of the passage 503 on the side of the circuit board 600 is formed to be the end surface of a protruding portion 503*c*. The protruding portion 503*c* is inserted into an insertion hole of the circuit board 600, which is described in detail below, so that the passage 503 opened to the end surface of the protruding portion 503*c* communicates with the supply communication hole of the retaining member 700.

Concave portions 504 are opened to the side of the circuit board 600 (to a first surface) are formed in the partition wall 502. The concave portions 504 are formed on both sides (in this embodiment, in a direction intersecting the arrangement direction of the head main bodies 1) of the passage 503 of each partition wall 502, as shown in FIG. 7A. The concave portions 504 are formed so as not to perforate through the partition wall 502 in the thickness direction. Therefore, as shown in FIG. 7B, the partition wall 502 on the side of the head main body 1 is a flat surface (a second surface). As shown in FIGS. 1 and 2, the head case 110 of the head main bodies 1 is fixed to the flat surface of the partition wall 502.

The passage member 500 can be formed by a mold of a resin material, for example.

As shown in FIGS. 1 and 2, the cover head 800 which is common to the plurality of head main bodies 1 is disposed on the ink ejection surface to which the nozzle openings 21 of the head main bodies 1 fixed to the passage member 500 are opened. In the cover head 800, a window portion 801 exposing the nozzle opening 21 of each head main body 1 is formed. The ink droplets are ejected from the nozzle opening 21 exposed via the window portion 801.

As shown in FIGS. 1 and 2 and FIGS. 8A to 8C, the circuit board 600 is retained on the side opposite to the head main bodies 1 with reference to the passage member 500.

Various wirings and electronic components are mounted in the circuit board 600. As shown in FIG. 8C, the circuit board 600 is retained in the passage member 500 so that a mounting portion 601 mounted with electronic components is on the side of the passage member 500. The mounting portion 601 has a terminal connected to a terminal of the COF board 410.

The mounting portion 601 is disposed so as to be received in the concave portion 504 of the passage member 500. With such a configuration, by narrowing the distance between the passage member 500 and the retaining member 700, it is possible to prevent the size of the ink jet printing head from being increased. Alternatively, when the mounting portion 601 of the circuit board 600 is formed on the side opposite to the passage member 500, the distance between the passage member 500 and the retaining member 700 has to be larger by the height of the mounting portion 601, thereby increasing the size of the ink jet printing head.

As shown in FIG. 8A, connection holes 602 perforating in the thickness direction are formed in the circuit board 600. Therefore, the front end portion of the COF board 410 inserted into the connection hole 602 is bent so as to be electrically connected to the circuit board 600.

As described above, the insertion holes 603 into which the protruding portion 503*c* of the passage member 500 is inserted are formed in the circuit board 600. By inserting the protruding portions 503*c* of the passage member 500 into the insertion holes 603, the passage 503 formed in the protruding portion 503*c* is opened to the outside (the side opposite to the passage member 500) of the circuit board 600 and is connected to a supply communication passage 712 of the retaining member 700, which is described below.

The circuit board 600 is electrically connected to an external wiring connection board 740 fixed to the side surfaces of the retaining member 700. Since an external wiring (not shown) into which a driving signal or the like is input to drive the piezoelectric element 300 is electrically connected to the external wiring connection board 740, the driving signal or the like from the external wiring is supplied to the head main body 1 (the COF board 410) via the external wiring connection board 740 and the circuit board 600.

As for the passage member 500 and the circuit board 600 having the above configuration, as described above, by forming the partition walls 502 in the passage member 500, it is possible to prevent the ink from invading from the space between the adjacent head main bodies 1 to the circuit board 600. That is, when the through-hole 501 common to the plurality of head main bodies 1 is formed without forming the partition wall 502, the head main bodies 1 may not be rigidly fixed to the passage member 500 and thus may be easily broken. Moreover, the ink may invade from the space between the adjacent head main bodies 1 to the circuit board 600, and thus electric short circuit or physical breaking may occur in the circuit board 600.

In this embodiment, by thickening the partition wall 502 and forming the concave portion 504 in the circuit board 600 of the partition wall 502, it is possible to prevent excessive swelling upon manufacturing the partition walls 502. Moreover, by improving the joint strength between the head main bodies 1 and the passage member 500, it is possible to prevent the breaking. When the thickness of the partition wall 502 is thick, the partition walls 502 may be redundantly swollen upon manufacturing the passage member 500 and thus the circuit board 600 or the head main bodies 1 may be mounted erroneously. In particular, when the passage member 500 is formed by a mold of a resin material, the excessive swelling may occur. When a thick portion exists in the molding, a so-called "sink marks" phenomenon occurs in which depressed portions occur due to contraction upon cooling a resin. An excessive swelling occurs in the thickness portion of the sink marks. Therefore, in this embodiment, by forming the concave portion 504 in the partition wall 502 which is the thick portion and removing the thick portion, it is possible to prevent the excessive swelling occurring due to the sink marks at the time of manufacture.

When the passage member 500 with a complicated shape is formed by another method other than the mold, the cost may be increased. When the thickness of the partition wall 502 is thin, a gap occurs between the head main body 1 and the partition wall 502. Therefore, the ink in the head main body 1 may flow around the circuit board 600 and a problem such as a short circuit may arise. Moreover, a problem may arise in that the ink flows in a gap between the partition wall 502 and the head main body 1, the ink drops in at an unexpected time, and thus a print medium serving as an ejection target medium such as a paper sheet is stained with the ink.

A method of opening the concave portion 504 on the side opposite to the circuit board 600, that is, on the side of the head main body 1 may be taken into consideration. However, when the concave portion 504 is opened on the side of the head main body 1, a problem may arise in that the ink is accumulated in the concave portion 504, the ink drops at an unexpected time, and thus a print medium such as a paper sheet is stained with the ink. Therefore, this method is not preferable.

In this embodiment, by forming the concave portion 504 or the through-hole 501 in the passage member 500, the inflow port 503*b* of the passage 503 is disposed in the direction intersecting the first direction even though the partition wall 502 is narrowed. Therefore, the passage 503 can be formed without widening the width of the partition wall 502.

Hereinafter, the retaining member 700 retaining the passage member 500 will be described with reference to FIGS. 1 and 2.

The retaining member 700 includes a base member 710 fixed to the surface (the surface to which the circuit board 600 is fixed) of the passage member 500 opposite to the head main bodies 1, a supply needle holder 720 in which a plurality of supply needles 730 is arranged, an external wiring connection board 740 fixed to one side surface of the base member 710, and a protective member 750 covering the external wiring connection board 740.

One surface of the base member 710 is fixed to the side of the circuit board 600 of the passage member 500, and the base member 710 retains the circuit board 600 in the space with the passage member 500.

The supply needle holder 720 is fixed to the base member 710 on the side opposite to the head main bodies 1.

A retaining wall 711 forms one side surface (which is a surface intersecting with the surface to which the passage member 500 and the supply needle holder 720 are fixed) of the base member 710. The external wiring connection board 740 is fixed to the outside of the retaining wall 711.

The external wiring connection board 740 retained in the retaining member 700 is mounted with electronic components for various driving signals and supplies the driving signals to the head main bodies 1 via the circuit board 600 connected to the COF boards 410 of the head main bodies 1. A connector 741 is disposed in the upper end portion (on the side opposite to the circuit board 600) of the external wiring connection board 740. Therefore, external wirings such as control cables are electrically connected from a control device to the external wiring connection board 740 via the connector 741.

The supply needle holder 720 is fixed to the base member 710 on the side opposite to the passage member 500 via a communication member 770. The supply needle holder 720 has a cartridge mounting portion 721 on which an ink cartridge serving as an ink storage unit storing the ink on the side opposite to the surface to which the base member 710 is fixed.

As shown in FIG. 2, supply communication passage forming portions 723, which have a tubular shape and a plurality of introduction holes 722 of which one end is opened to the cartridge mounting portion 721 and the other end is opened to the base member 710, are formed so as to protrude on the bottom surface of the supply needle holder 720. The introduction hole 722 is connected to the inflow port 503*b* of the passage 503 via the supply communication passages 712 formed in the communication member 770 and the base member 710.

A plurality of supply needles 730 inserted into the ink cartridges is fixed to the surface of the supply needle holder 720, that is, the opened portions of the introduction holes 722 of the cartridge mounting portion 721 via filters 731 (see FIG. 2) filtering bubbles of the ink or foreign particles.

Each supply needle 730 has a through passage (not shown) communicating with the introduction hole 722 therein. When the supply needle 730 is inserted into the ink cartridge, the ink in the ink cartridge is supplied to the introduction hole 722 of the supply needle holder 720 via the through passage of the supply needle 730. The ink introduced to the introduction hole 722 is supplied to the passage 503 via the supply communication passages 712 formed in the communication member 770 and the base member 710 and is supplied to the ink introduction passage 111 of the head main body 1 via the passage 503.

The protective member 750 has a box-like shape of one side surface and the upper surface that are disposed outside the retaining wall 711 are opened. As described above, the protective member 750 is fixed to the base member 710 to cover the external wiring connection board 740 fixed to the retaining wall 711.

The protective member 750 is opened to the connector 741 (on the upstream side) of the external wiring connection board 740 so that the connector 741 is connected to an external wiring.

By protecting the external wiring connection board 740 by the protective member 750, it is possible to prevent the breakdown of the external wiring connection board 740 due to collision with an outside object or it is possible to prevent a problem such as the short circuit caused due to attachment of foreign matters such as ink or dust. Moreover, by sealing the space, where the circuit board 600 and the COF board 410 are connected to each other, except for a partial area in the vicinity of the connector 741 located on the upper side, it is possible to prevent the ink from invading the inside. Since the ink ejection surface of the ink jet printing head I faces the lower side of FIG. 1, that is, is the surface opposite to the connector 741 of the external wiring connection board 740, the ink rarely flows inside even when the side of the connector 741 is opened. When the opening in the vicinity of the connector 741 is closed by resin or the like, it is possible to prevent the ink from invading more reliably.

In this embodiment, the circuit board 600 is connected to the COF board 410 of the head main body 1 between the passage member 500 and the retaining member 700 and the circuit board 600 connected to the COF board 410 is connected to the external wiring connection board 740 disposed in the retaining member 700 which is a member different from the passage member 500.

Since the passage member 500 retaining the head main bodies 1 and the retaining member 700 retaining the external wiring connection board 740 are configured as the separate members, the circuit board 600 and the COF board 410 can be connected to each other in the state where the head main bodies 1 and the passage member 500 are joined, before the passage member 500 and the retaining member 700 are joined to each other. With such a configuration, it is possible to easily connect the COF board 410 to the circuit board 600. Moreover, it is possible to easily connect the circuit board 600 to the external wiring connection board 740.

In the ink jet printing head I according to this embodiment, the passage member 500 and the retaining member 700 are configured as the separate members and the circuit board 600 and the COF board 410 are connected to each other between the passage member 500 and the regaining member 700. With such a configuration, since the circuit board 600 is easily treated, the plurality of head main bodies 1 is easily connected to one circuit board 600, it is possible to miniaturize the ink jet printing head I and it is possible to reduce the cost. Moreover, when the passage member 500 and the retaining member 700 are integrally formed, it is not easy to connect the plurality of head main bodies 1 to one circuit board 600. This is because when the passage member 500 and the retaining member 700 are formed by a mold, it is substantially difficult to partition a space in the upper direction of the partition wall 502. Therefore, since the space may not be formed to retain the circuit board 600 between the passage member 500 and the retaining member 700, only a partitioned through-hole is formed in each head main body 1 and thus the number of circuit boards partitioned by the same number as the number of head main bodies 1 is necessary. Moreover, when the circuit board is disposed in each head main body 1, the number of components is increased and thus the cost is also increased. When the passage member 500 and the retaining member 700 are integrally formed, the head main body 1 and the circuit board have to be inserted into the through-hole upon attaching the head main body 1 to the passage member 500 in the state where each circuit board is connected to each head main body 1. Therefore, the adhesive attaching the head main body 1 and the passage member 500 may easily be attached to the circuit board. Moreover, a failure to connect the circuit board to the external wiring connection board may occur due to the excessive adhesive. Alternatively, a failure to connect the head main body 1 to the passage member 500 may occur due to the shortage of the adhesive. In this embodiment, even when the circuit board 600 is disposed in each head main body 1 or a group of the plurality of head main bodies 1, it is easy to treat the circuit board 600. Therefore, it is possible to obtain an advantage of reliably connecting the circuit board 600 to the COF board 410.

In the ink jet printing head I with such a configuration, the ink from the ink cartridge flows in the manifold 100 via the through-hole 501, the supply communication passage 712, the passage 503, the ink introduction passage 111, and the ink inflow port 44. Therefore, the passage from the manifold 100 to the nozzle opening 21 is filled with the ink. Thereafter, by applying a voltage to each piezoelectric element 300 corresponding to each pressure generating chamber 12 in accordance with a print signal supplied from the external wiring connection board 740 via the circuit board 600 and the COF board 410, the piezoelectric element 300 and the vibration plate are deformed, the pressure of each pressure generating chamber 12 is increased, and thus ink droplets from each nozzle opening 21 are ejected.

Other Embodiments

Figure 9A:
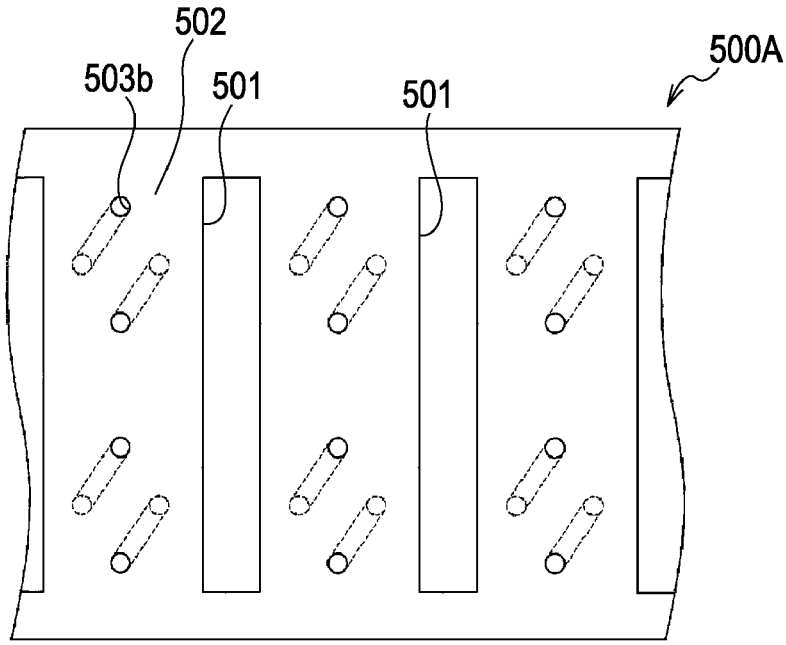
FIGS. 9A and 9B are plan views illustrating the passage member according to another embodiment of the invention.
Figure 9B:
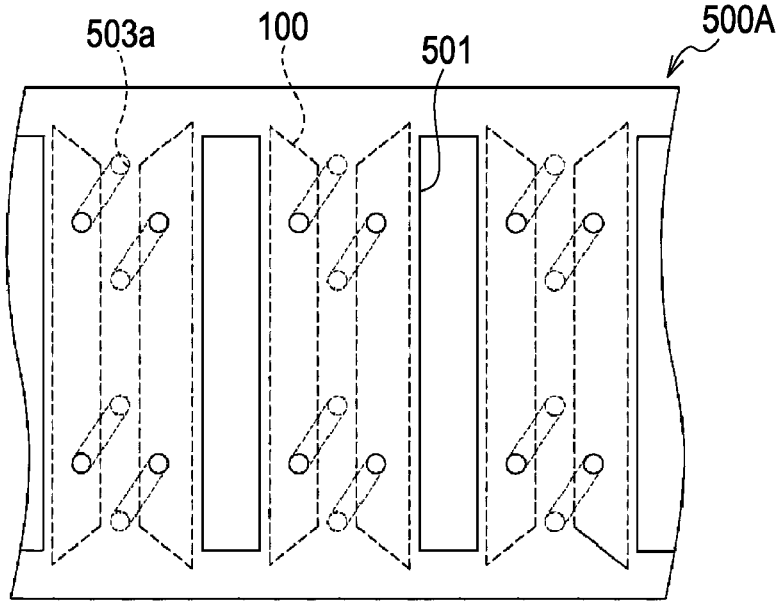

The embodiment of the invention has been described, but the invention is not limited to the above-described configuration. For example, in the above-described first embodiment, two passages 503 formed on one partition wall 502 organize the passage group, but the number and positions of the passages 503 is not limited to the above-described example. Here, another example is shown in FIGS. 9A and 9B. FIGS. 9A and 9B are plan views illustrating a passage member according to another embodiment of the invention. As shown in FIGS. 9A and 9B, a passage member 500A includes the plurality of through-holes 501 and the partition walls 502 partitioning the adjacent through-holes 501. Four passages 503 are formed in the partition wall 502. As shown in FIG. 9A, the inflow ports 503*b* of four passages 503 formed on one partition wall 502 are arranged in the direction inserting the first direction. As shown in FIG. 9B, each two outflow ports 503*a* of the passage 503 are arranged in the first direction. That is, the outflow ports 503*a* are arranged in two rows arranged in the first direction in the direction intersecting the first direction. Here, one passage group is organized by two passages 503 formed on one partition wall 502 and of which the outflow ports 503*a* are arranged in the first direction.

With such a configuration, each of the passages 503 of one passage group disposed on one partition wall 502 communicates with one end of each manifold 100 of the adjacent head main bodies 1 in the longitudinal direction of the manifold 100. Each of the passages 503 of the other passage group disposed on one partition wall 502 communicates with the other end of each manifold 100 of the adjacent head main bodies 1 in the longitudinal direction of the manifold 100. That is, since the two passages 503 communicate with one manifold 100, the two passages 503 communicating with the same manifold 100 organize another passage group.

In this way, even when the manifold 100 is lengthened in the longitudinal direction (the arrangement direction of the nozzle openings 21), it is possible to reduce the difference between the pressure loss slopes of the respective passages (the pressure generating chambers 12 and the like) communicating with all of the nozzle openings 21. Accordingly, it is possible to improve the ink ejection characteristics. Moreover, it is possible to improve the print quality.

In the above-described first embodiment, for example, the COF boards 410 are disposed on both side surfaces of the supporting member 400. However, two or more COF boards 410 may be disposed on each side surface of the supporting member 400. For example, the COF boards 410 may be disposed only on one side surface of the supporting member 400. Alternatively, one COF board may be formed as the COF boards 410 formed on both side surfaces of the supporting member 400. Alternatively, the driving circuit 200 is disposed in another place and a wiring board with no circuit other than the COF board may be used.

In the above-described first embodiment, two rows in which the pressure generating chambers 12 are arranged in the passage forming board 10 are formed, but the invention is not limited to the number of rows. One row or three or more rows may be formed. When the plurality of rows is formed, it is preferable to form at least a pair of two rows.

In the above-described first embodiment, the actuator device including the thin film type piezoelectric element 300 is used as the pressure generating element generating the pressure change to the pressure generating chamber 12. However, the invention is not limited thereto. For example, a thick film type actuator device formed by a method of attaching a green sheet may be used. Alternatively, a vertical vibration type actuator device may be used which is formed by alternating piezoelectric materials and electrode forming materials and can be expanded and contracted in an axis direction. An actuator device may be used in which a heating element serving as a pressure generating element is disposed in the pressure generating chamber and which ejects liquid droplets from the nozzle openings by bubbles generated by the heat of the heating element. Alternatively, a so-called electrostatic actuator device may be used which generates an static force between a vibration plate and an electrode and deforms the vibration plate by the electrostatic force to eject liquid droplets from nozzle passages.

Figure 10:
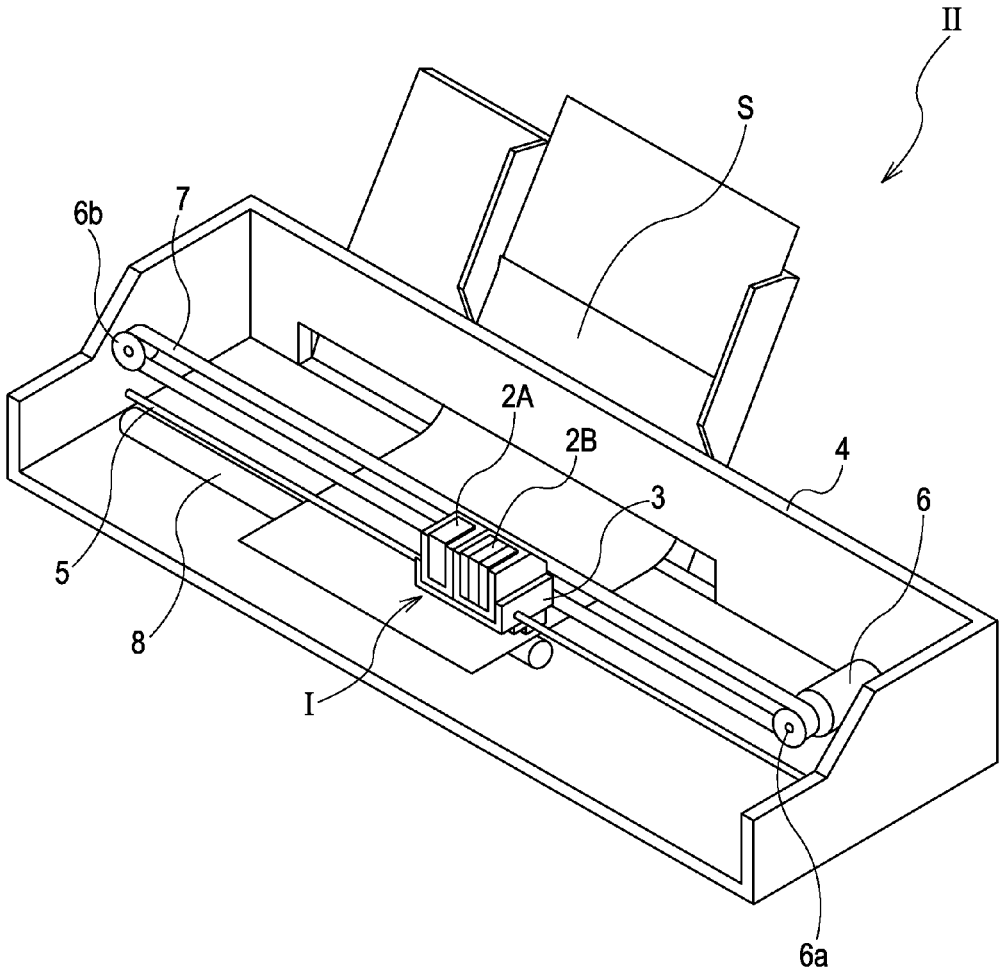
FIG. 10 is a schematic view illustrating an ink jet printing apparatus according to an embodiment of the invention.

The ink jet printing head I according to the above-described embodiment is mounted in an ink jet printing apparatus II. FIG. 10 is a schematic diagram illustrating an exemplary ink jet printing apparatus. As shown in FIG. 10, the ink jet printing head I is detachably installed so as to be mounted with cartridges 2A and 2B serving as ink supply units. A carriage 3 mounting the ink jet printing head I is disposed so as to be movable in a shaft direction along a carriage shaft 5 mounted in an apparatus main body 4. The ink jet printing head I ejects a black ink composition and color ink compositions, for example.

When a driving force of a driving motor 6 is delivered to the carriage 3 via a plurality of gears and a timing belt 7 (not shown), the carriage 3 mounting the ink jet printing head I is moved along the carriage shaft 5. On the other hand, a platen 8 is disposed in the apparatus main body 4 along the carriage shaft 5, a printing medium such as a paper sheet S fed by a feeding roller or the like (not shown) is wound around the platen 8 to be transported. The invention is applied to a general liquid ejecting head. For example, the invention is applicable to a printing head such as various ink jet printing heads used in an image forming apparatus such as a printer, a color material ejecting head used in manufacturing a color filter such as a liquid display, an electrode material ejecting head used in forming electrodes such as an organic EL display and an FED (Field Emission Display), and a bio organism ejecting head used in manufacturing a bio chip.

The ink jet printing apparatus II has been described as the exemplary liquid ejecting apparatus. However, the invention is applicable to a liquid ejecting apparatus using a head ejecting another liquid.

What is claimed is:

1. A liquid ejecting head comprising:

a plurality of head main bodies in which nozzle openings are arranged and manifolds communicate with the nozzle openings; and a passage member which includes a plurality of passages supplying a liquid supplied from an upstream side to the plurality of manifolds of the head main bodies, wherein the plurality of head main bodies are disposed so that the manifolds are arranged in a first direction, and wherein the plurality of passages of the passage member includes a passage group in which outflow ports communicating with the manifolds are disposed in the first direction and inflow ports to which the liquid is supplied from the upstream side are disposed in a second direction intersecting the first direction, and wherein the passages organizing the passage group communicate with the manifolds different from each other.

2. The liquid ejecting head according to claim 1, further comprising:

a second passage member in which a supply communication passage communicating with the inflow port of the passage member is formed.

3. The liquid ejecting head according to claim 1, wherein the lengths of the plurality of passages of the passage member are equal to each other.

4. The liquid ejecting head according to claim 2, wherein the head main body includes a pressure generating chamber communicating with the nozzle opening, an actuator device generating pressure variation in the pressure generating chamber, and a wiring member connected to the actuator device, and wherein a circuit board connected to the wiring member and supplying a driving signal to the actuator device via the wiring member is disposed between the passage member and the second passage member.

5. The liquid ejecting head according to claim 4, wherein the wiring member is a flexible wiring member in which a wiring is formed in a flexible member.

6. The liquid ejecting head according to claim 4, wherein the wiring member is inserted into a through-hole formed between the adjacent passage groups of the passage member.

7. A liquid ejecting apparatus comprising:

a liquid ejecting head that includes:

a plurality of head main bodies in which nozzle openings are arranged and manifolds communicate with the nozzle openings; and a passage member which includes a plurality of passages supplying a liquid supplied from an upstream side to the plurality of manifolds of the head main bodies, wherein the plurality of head main bodies are disposed so that the manifolds are arranged in a first direction, and wherein the plurality of passages of the passage member includes a passage group in which outflow ports communicating with the manifolds are disposed in the first direction and inflow ports to which the liquid is supplied from the upstream side are disposed in a second direction intersecting the first direction, and wherein the passages organizing the passage group communicate with the manifolds different from each other.

8. The liquid ejecting apparatus according to claim 7, wherein the liquid ejecting head further comprises:

a second passage member in which a supply communication passage communicating with the inflow port of the passage member is formed.

9. The liquid ejecting apparatus according to claim 7, wherein the lengths of the plurality of passages of the passage member are equal to each other.

10. The liquid ejecting apparatus according to claim 8, wherein the head main body includes a pressure generating chamber communicating with the nozzle opening, an actuator device generating pressure variation in the pressure generating chamber, and a wiring member connected to the actuator device, and wherein a circuit board connected to the wiring member and supplying a driving signal to the actuator device via the wiring member is disposed between the passage member and the second passage member.

11. The liquid ejecting apparatus according to claim 10, wherein the wiring member is a flexible wiring member in which a wiring is formed in a flexible member.

12. The liquid ejecting apparatus according to claim 10, wherein the wiring member is inserted into a through-hole formed between the adjacent passage groups of the passage member.

* * * * *